United States Patent [19]

Graesslin et al.

[11] 4,012,607

[45] Mar. 15, 1977

[54] MINIATURE TIMER

[75] Inventors: Dieter Graesslin; Peter Schonhardt, both of Georgen, Black Forest, Germany

[73] Assignee: Dieter Graesslin Feinwerktechnik, Germany

[22] Filed: Dec. 16, 1974

[21] Appl. No.: 533,228

[30] Foreign Application Priority Data

Dec. 17, 1973 Germany ..... 2362563

[52] U.S. Cl. ..... 200/38 D; 200/293

[51] Int. Cl.[2] ..... H01H 9/00; H01H 43/00

[58] Field of Search ..... 200/38 R, 38 FA, 38 B, 200/38 BA, 38 C, 38 CA, 293–296, 38 D, 38 DA, 38 DB, 38 DC, 283, 284

[56] References Cited

UNITED STATES PATENTS

| | | | |
|---|---|---|---|
| 2,816,184 | 12/1957 | Manning et al. | 200/38 DA |
| 2,900,463 | 8/1959 | Schultz et al. | 200/38 DB |
| 3,104,300 | 9/1963 | Hutt | 200/295 X |
| 3,226,494 | 12/1965 | Hartz et al. | 200/295 X |
| 3,248,493 | 4/1966 | Bassett | 200/38 DA X |
| 3,501,608 | 3/1970 | Rulseh et al. | 200/296 X |
| 3,588,391 | 6/1971 | Banathy et al. | 200/38 B X |
| 3,694,591 | 9/1972 | Bassett et al. | 200/38 FA |
| 3,699,277 | 10/1972 | Straub | 200/38 B X |
| 3,727,015 | 4/1973 | Voland et al. | 200/283 X |
| 3,737,597 | 6/1973 | Jones et al. | 200/38 BA |
| 3,775,574 | 11/1973 | Coe | 200/38 BA |
| 3,823,280 | 7/1974 | Obermann et al. | 200/38 B |

*Primary Examiner*—James R. Scott
*Attorney, Agent, or Firm*—Hill, Gross, Simpson, Van Santen, Steadman, Chiara & Simpson

[57] ABSTRACT

A miniature timer device having a housing divided into a plurality of chambers for housing a reduction gear system, a motor and an electrical contact system and wherein bearing means for support of these items are formed integrally with the housing structure.

7 Claims, 10 Drawing Figures

Fig. 1
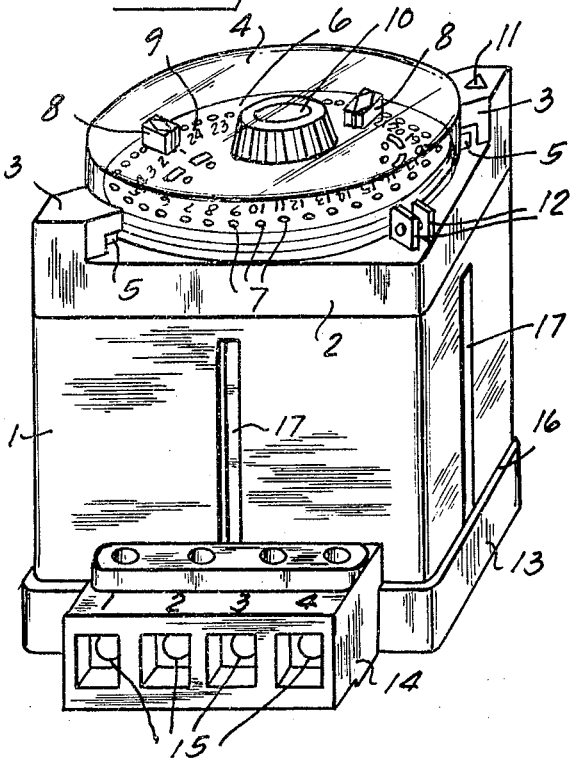
Fig. 2
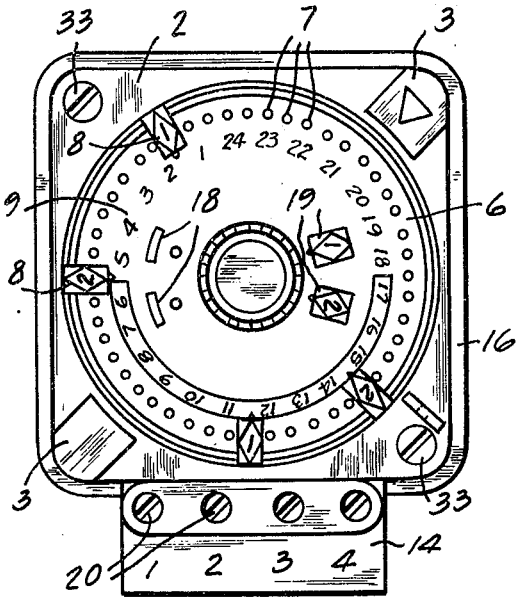
Fig. 3
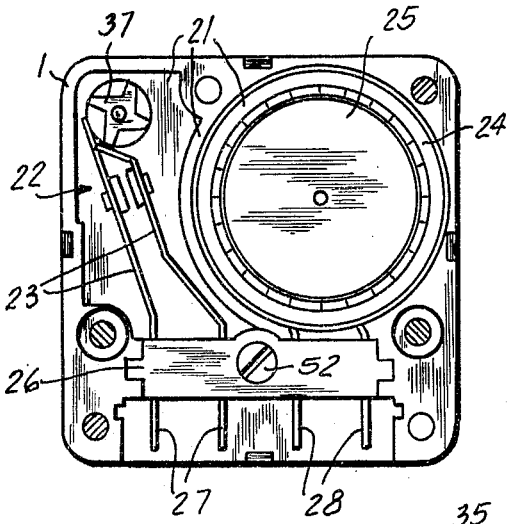
Fig. 4
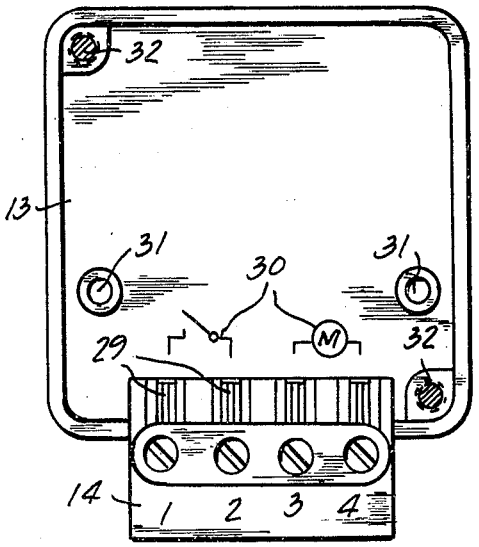
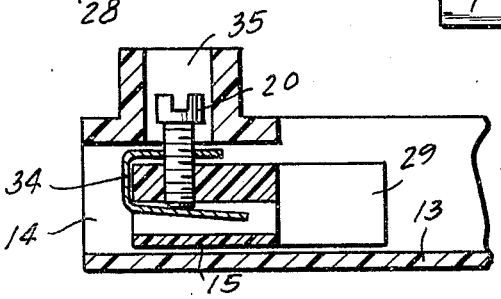
Fig. 5

Fig. 6
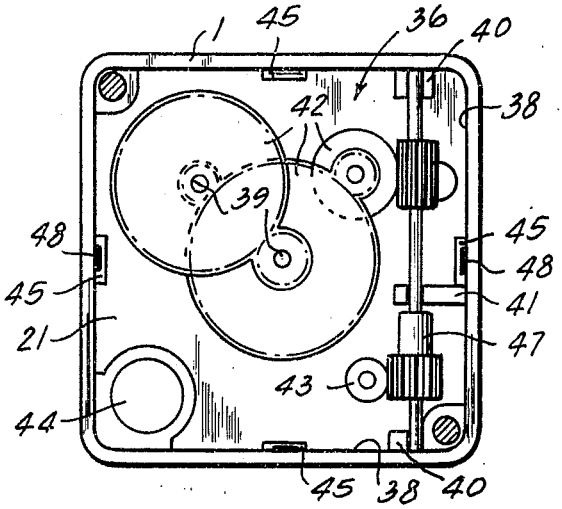
Fig. 7
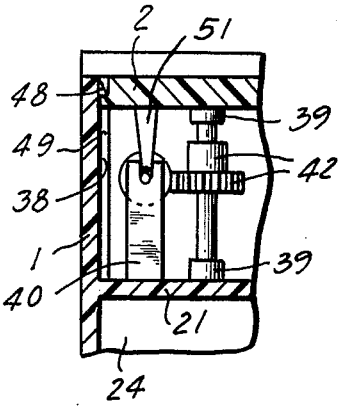
Fig. 8
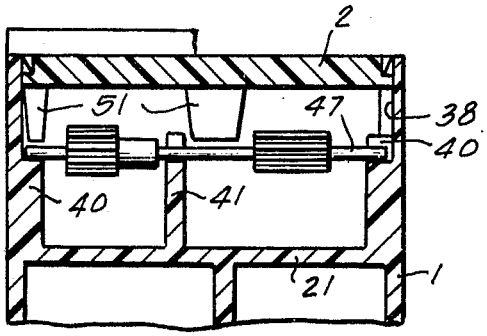
Fig. 9
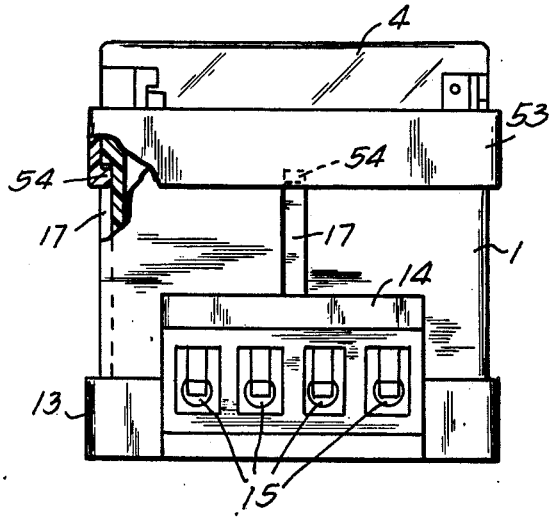
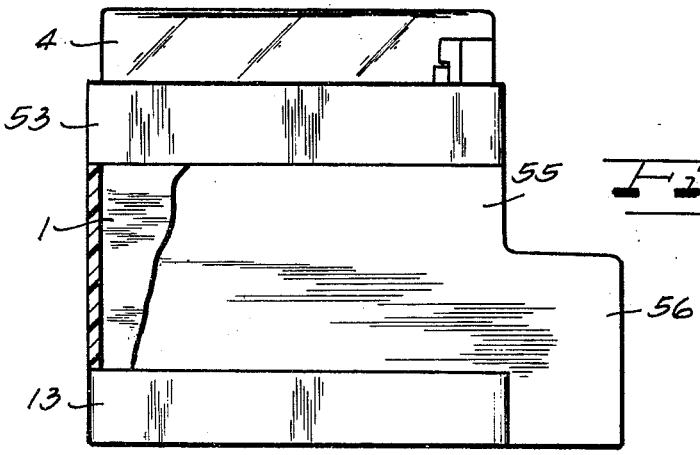
Fig. 10

MINIATURE TIMER

BACKGROUND OF THE INVENTION

This invention relates to a synchronous motor driven miniature timer having a switching disk for the actuation of electric contact system.

Miniature timers are being used to an increasing extent for keeping time in the control of various types of operations. The component elements in such control systems, which become smaller and smaller, require a miniature timer adapted spacially to these systems. The timer should also be provided with sufficient operating systems and switching time programming systems in accordance with the requirements, as well as a controllable time keeping contact system which is designed for fairly large electrical loads. In addition, it should be provided with electrical installation and mounting systems which are adequate in the light of the most common demands required of such devices.

Prior art electric miniature timers mostly have a rectangular flange cross-section in accordance with DIN (German Industrial Standards — Deutsche Industrie Normen) 43,700 having a dimension of 72 × 72 mm., and having a corresponding insert cross-section in the dimension of 66 × 66 mm. Such miniature timers, however, are too large for many applications. Oftentimes they are also not economically feasible. These prior art miniature timers often have a variety of dimensions which cannot be easily integrated into control systems and, in particular, into instruments which have standardized flange dimensions. Accordingly, it becomes appropriate to provide a miniature timer with a rectangular and relatively small housing cross-section which corresponds to standardized space requirements and which may be economically constructed. It also becomes appropriate in such a miniature timer to provide a simple and distinctly programmable switch disk and mounting systems and electrical installation systems which are adapted to various standardized requirements.

SUMMARY OF THE INVENTION

An object of this invention is to provide a miniature timer with a rectangular relatively small housing cross-section corresponding to standardized dimensions.

Another object of the invention is to provide a miniature timer having a housing separated by a separating wall into a front chamber and a rear chamber, one chamber for housing a synchronous motor and an electrical contact system, and the other for housing a reduction gear system.

Other objects and advantages will become more apparent when considering the following description and the accompanying drawings.

BRIEF DESCRIPTION OF THE DRAWINGS

FIG. 1 is a perspective view of a miniature timer embodying the invention herein;

FIG. 2 is a front view in elevation of the miniature timer of FIG. 1 showing the switching disk with the clear-view hood removed;

FIG. 3 is a cut-away view of the rear portion of the miniature timer of FIG. 1 showing the bearing chambers for the synchronous motor and the electric contact system;

FIG. 4 is a cut-away front view of the miniature timer housing socket showing the electric installation connection system;

FIG. 5 is an enlarged partial sectional side view through the miniature timer socket showing the electric installation connection terminal;

FIG. 6 is a view onto the front housing wall showing the bearing chamber for the gear drive elements;

FIG. 7 is a partial longitudinal sectional view through a part of the housing showing a portion of the bearing chamber for the gear drive elements;

FIG. 8 is a partial longitudinal sectional view rotated 90° with respect to the view of FIG. 7 through a part of the housing showing the bearing chamber for the gear drive elements;

FIG. 9 is a side view partially in section of a miniature timer constructed in accordance with the invention which includes a plug-on insertion frame flange;

FIG. 10 is a side view of a miniature timer showing an assembly mounting having a plugged on upper housing.

DESCRIPTION OF A PREFERRED EMBODIMENT

It is a purpose of the invention herein to provide a miniature timer with a rectangular relatively small housing cross-section adaptable to standardized space requirements which can be constructed economically, which has a simple and distinctly programmable switch disk and which includes mounting systems and electric installation systems which are adapted to various requirements.

At the front of the inner space of the timer housing a bearing chamber for a reduction gear system is provided. The inner space of the housing is separated by an intermediate or separator wall into front and rear portions. At the rear portion of the housing a bearing chamber is provided for a synchronous motor and for an electric contact system. The intermediate or separating wall is integrally connected with the housing side walls of the miniature timer.

The front of the bearing chamber for the reduction gear system is defined by a front plate or platen which may be provided with bearings journals and bearing support brackets on the inner surface of the plate which faces inwardly toward the bearing chamber. The switching disk preferably is mounted in a recessed portion of the front plate. Furthermore, guide and clamping attachment means are provided on the front of this plate or platen which are fixed in position. The front plate may be attached onto the housing by being snapped in place thereon. The outer or front surface of the plate is also provided with means for detachably securing thereto a clear-view hood which covers the switching disk.

The bearing chambers formed in the rear of the housing are covered on the rear housing side by the housing socket. The housing socket serves to support the electrical installation connection terminals. In addition, it may be provided that the cylindrically shaped bearing chamber for the synchronous motor may be closed off independently from the covering by the housing socket by its own covering cap.

Turning now to the drawings, FIG. 1 shows a housing 1 of the miniature timer which may be made of a plastic material. The housing 1 comprises a unit having a generally square cross-section an preferably measuring 45 × 45 mm. on each side corresponding to the German Industrial Standard 43,700. The upper portion of the housing 1 is covered by a front plate or platen 2 which preferably is snapped into engagement on the edge of the housing 1 to thus fix it in a position to fixedly attach it to the housing 1.

The front plate 2, which also preferably is produced of plastic material, has integrally formed on its upper face diagonally disposed snapping or securing elements 3 positioned substantially at the corners of the plate 2. These securing elements 3 are used to secure in place a substantially annular clear-view hood 4 on the front plate 2 by means of the integrally formed tongues 5 on the hood which engage with the securing elements 3. The clear-view hood 4 covers a switching disk 6 which is rotatably disposed on the outer face of the front plate 2. The disk 6 is provided with circumferentially spaced holes 7 at the periphery thereof into which slide contacts 8 may be manually plugged to form a time keeping, programmable scale 9. A knob 10 is positioned at the center of the switching disk 6 for rotation thereof. The hood 4 can be easily removed from the miniature timer by rotating it to a position where the tongues 5 do not engage the securing elements 3. A reference arrow 11 is arranged on one of the securing elements 3 as a stationary time reference point with respect to the scale 9. Parallel bars 12 are arranged on the outer face of the front plate 2 at a point adjacent the periphery of the hood 4 and these permit the lead sealing of the clear-view hood 4 and the front plate 2.

A housing socket 13 for mounting the timer is provided with a frame 14 in which the electric installation connection system is supported. The housing socket 13 has a square cross-section measuring 48 × 48 mm. which corresponds to the German Industrial Standard. It forms a cover over the rear end of the housing and has a margin 16 extending around the housing socket periphery. Grooves 17 are disposed centrally of each of the side surfaces of the housing. The grooves 17 are adapted for supporting a so-called insertion flange ring further referred to hereinafter.

FIG. 2 shows a front view of the timer and illustrates more clearly the arrangement of the switching disk 6 on the face of the front plate 2. Openings 18 are provided in the switching disk 6 which serve for mounting so-called reserve contact switches 19. Clamping screws 20 are provided in openings in the frame 14 for securing the electrical connection terminals 15 within the frame 14.

FIG. 3 is a cut-away view of the rear portion of the miniature timer housing 1 showing portions of the intermediate or separating wall 21, a bearing chamber 22 for an electrical contact system, and a bearing chamber 24 in which a synchronous motor 25 is mounted. A cross member 26 is secured in the housing by a screw 52. Flat contact plug pairs 27 and 28 are mounted in the cross member 26 and are appropriately insulated. The plug pair 27 interconnects with the electrical contact system 23 and plug pair 28 interconnects with the electrical connection to the synchronous motor 25. Mounting holes 31 are provided in the housing socket 13. Diagonally disposed threaded bores 32 are provided in the housing socket 13 of mounting the miniature timer on the housing socket 13. A star switch 37 is rotatably disposed in the bearing chamber 22 for actuating the electrical contact mechanism 23 and it is arranged to be actuated by the slide switches 8 shown in FIGS. 1 and 2.

In FIG. 5 there is shown a section through a chamber of the frame 14 mounted on the housing socket 13 showing therein the electrical connector terminal 15. The terminal 15 is provided on its front side with a cable clamping unit 34 and a flexible knife blade contact frame 29 at its rear. The terminal 15 is positioned relatively loosely within the frame 14 by means of the clamping screw 20.

In FIG. 6 there is shown a view of the bearing chamber 36 in which the reduction gear system is arranged. The intermediate wall or separating wall 21 is shown in FIGS. 6, 7 and 8. The wall 21 is formed integrally with the housing side walls 38 of the housing 1. Bearing journals 39, bearing supports 40, and shaft support brackets 41 are formed integrally with the side walls 38 or the separating wall 21 in the bearing chamber 36 for direct and/or indirect support of the gearing system including elements 42, 43 and 47. A bearing tube 44 accommodates the star switch mechanism 37 shown in FIG. 3. Support brackets 45 positioned on the inner surface of the side walls of the housing 1 provide support for the front plate 2. Snap closures 48 may also be attached to the inner walls of the housing 1 to engage the front plate 2 for holding it in position within the housing.

In FIG. 7 there is shown a portion of the housing 1 showing the bearing chamber 36 of the housing 1 defined between the front plate 2 and the intermediate or separating wall 21. FIG. 7 shows more clearly the front plate 2 held in place within the upper end of the housing 1 by the snap closure members 48. Spacer members 49 which are formed integrally with the side walls of the housing 1 limit the distance that the front plate 2 may be inserted into the housing 1. FIG. 8 also illustrates that portion of the housing in which the bearing chamber 36 is disposed, that is an area defined between the front plate 2 and the intermediate wall 21. Bearing journals 39 shown in FIG. 7 are formed integrally respectively with the front plate 2 and the intermediate wall 21 for supporting therein gear elements 42. In addition, bearing supports 40 are provided for supporting the gearing arrangement 47. The bearing supports 40 are more clearly shown in FIG. 8 as being an integral part of the side walls 38 of the housing 1. In addition, it will be observed that supports brackets 41 for the gearing elements 47 are integrally formed with the intermediate wall 21. In addition, members 51 are integrally formed with and depend from the inner surface of the front plate 2. The members 51 are arranged to hold the shaft 47 and the gearing mounted thereon in place.

FIG. 9 shows a miniature timer which, in accordance with this invention, includes a so-called insertion flange ring 53 which may be assembled onto the housing from the rear of the housing. It will be observed that the flange ring 53 is provided with inwardly projecting portions 54 which are adapted to engage with the grooves 17 formed on the outside of the walls of the housing 1. Since the grooves 17 terminate at a point near the upper end of the housing 1, the projections 54 engage this termination point of the grooves 17 and thereby axially position the flange ring 53. With the assistance of this insertion flange ring 53 which is locked to the housing 1, the miniature timer can be inserted into a switchboard so that the insertion flange ring 53 serves as a front axial assembly boundary. The miniature timer thus is suspended with the help of a suspension brace (not shown) which attaches from the back against the insertion flange 53.

FIG. 10 shows a miniature timer constructed in accordance with the invention and supported in an assembly mounting. In this particular embodiment, in order to protect against contact of the electrical installation terminal devices, an upper housing 55 is mounted over the housing 1 between the insertion flange ring and the housing socket 13. It is provided with a cover 56 which covers the electrical installation terminal system. The upper housing 55 together with the insertion flange ring and the socket 13 forms an integral unit with the housing 1 and preferably is produced of a plastic material.

What is claimed is:

1. A miniature timing switch comprising an electrically-driven motor, a switchable electric contact for selectively connecting two conductor elements, a gear drive system connecting an output of said motor to drive a programmable actuator mechanism for selectively opening and closing said electric contact, and an insulating housing mounting and containing said motor, contact, conductor elements, gear system, and actuator mechanism, and segregating electrical components from mechanical components of the switch, wherein the housing comprises:

a base plate;

an annular, upstanding wall attached to said base plate about a periphery thereof;

a dividing wall extending parallel to said base plate interiorly of said upstanding wall and spaced from said base plate to form a first, electrical chamber; and a front plate attached to an end of said upstanding wall opposite said base plate and spaced from said dividing wall to form a second, mechanical chamber separated from said electrical chamber, said front plate carrying a portion of said programmable actuator mechanism adjacent an outer surface thereof.

2. A miniature timing switch as defined in claim 1, wherein said base plate is square.

3. A miniature timing switch as defined in claim 2, wherein a length of a side of said base plate is approximately equal to a diameter of a time-setting disk forming said portion of the programmable actuator mechanism.

4. A miniature timing switch as defined in claim 1, wherein said motor, said electric contact, and said conductor elements are contained within said first chamber, and said gear-drive system and motor output are contained in said second chamber.

5. A miniature timing switch as defined in claim 1, wherein said intermediate dividing wall comprises a bearing portion accepting an output shaft of said motor output and a bearing tube accepting a star switch portion of said actuator mechanism, both said bearing portion and said bearing tube passing through said dividing wall, and said dividing wall carrying at least one shaft bearing on an upper side thereof for supporting an element of said gear drive system.

6. A miniature timing switch housing comprising:

an annular side wall having first and second ends;

a base plate attached to and enclosing said first end of said side wall;

a front plate attached to and enclosing said second end of said side wall; and an intermediate dividing wall affixed inwardly of and carried by said side wall and spaced from and between said base and front plates, the dividing wall separating and electrically insulating said housing into first and second chambers respectively inwardly adjacent said base and front plates, said dividing wall having first means carrying a timing motor and an electrical contact switch on a rear side thereof in said first chamber, and said dividing wall having second means carrying portions of a gear reduction system and of a programmable switch actuating mechanism on a front side thereof in said second chamber.

7. A miniature timing switch housing as defined in claim 6, wherein said base plate and said front plate each have four sides of equal length and said front plate carries a programming switch disk exposed on an outer surface thereof, the disk having a diameter of a length approximately equal to the length of a side of one of the base and front plates.

* * * * *